US006814548B2

(12) United States Patent
Sagnet

(10) Patent No.: US 6,814,548 B2
(45) Date of Patent: Nov. 9, 2004

(54) MULTIPLE PISTON ENGINE WITH VIBRATION REDUCING PROPERTIES

(75) Inventor: Michel Sagnet, Paris (FR)

(73) Assignee: Peugeot Citroen Automobiles S.A., Neuilly sur Seine (FR)

( * ) Notice: Subject to any disclaimer, the term of this patent is extended or adjusted under 35 U.S.C. 154(b) by 77 days.

(21) Appl. No.: 10/149,588

(22) PCT Filed: Dec. 8, 2000

(86) PCT No.: PCT/FR00/03456

§ 371 (c)(1),
(2), (4) Date: Oct. 3, 2002

(87) PCT Pub. No.: WO01/44659

PCT Pub. Date: Jun. 21, 2001

(65) Prior Publication Data

US 2003/0059314 A1 Mar. 27, 2003

(30) Foreign Application Priority Data

Dec. 17, 1999 (FR) ..... 99 15969

(51) Int. Cl.[7] ..... F04B 1/04

(52) U.S. Cl. ..... 417/273; 417/523; 92/60.5; 92/143

(58) Field of Search ..... 417/273, 523, 417/545, 554; 60/469; 92/143, 170.1, 60.5

(56) References Cited

U.S. PATENT DOCUMENTS

| | | | | | |
|---|---|---|---|---|---|
| 1,625,789 | A | * | 4/1927 | Braselton et al. | 417/554 |
| 4,909,064 | A | * | 3/1990 | Talmadge | 73/1.82 |
| 5,051,069 | A | | 9/1991 | Ikeda et al. | |
| 5,809,865 | A | | 9/1998 | Ikeda et al. | |
| 5,975,864 | A | * | 11/1999 | De Santis et al. | 417/273 |
| 5,983,780 | A | | 11/1999 | Nakamoto et al. | |

FOREIGN PATENT DOCUMENTS

| | | |
|---|---|---|
| DE | 196 41 779 | 1/1988 |
| FR | 1.546.997 | 12/1967 |
| FR | 2 446 393 | 8/1980 |
| FR | 2 551 505 | 3/1985 |
| FR | 2 655 690 | 6/1991 |

* cited by examiner

*Primary Examiner*—Cheryl J. Tyler
(74) *Attorney, Agent, or Firm*—Leydig, Voit & Mayer, Ltd.

(57) ABSTRACT

The invention relates to a piston engine which is essentially comprised of an engine shaft and a set of modules, each of which comprises a cylinder and a piston powered by the engine shaft in the cylinder, each module resulting in vibratory excitation of the engine at a determined fundamental frequency. Rather than introducing phase differences between the various vibratory excitations, as is the case in prior art, the invention introduces a frequency offset between the fundamental frequencies thereof in order to avoid a high-amplitude vibration at a common excitation frequency, arising from the spectral spread thus obtained.

20 Claims, 1 Drawing Sheet

MULTIPLE PISTON ENGINE WITH VIBRATION REDUCING PROPERTIES

BACKGROUND OF THE INVENTION

Figure 1:
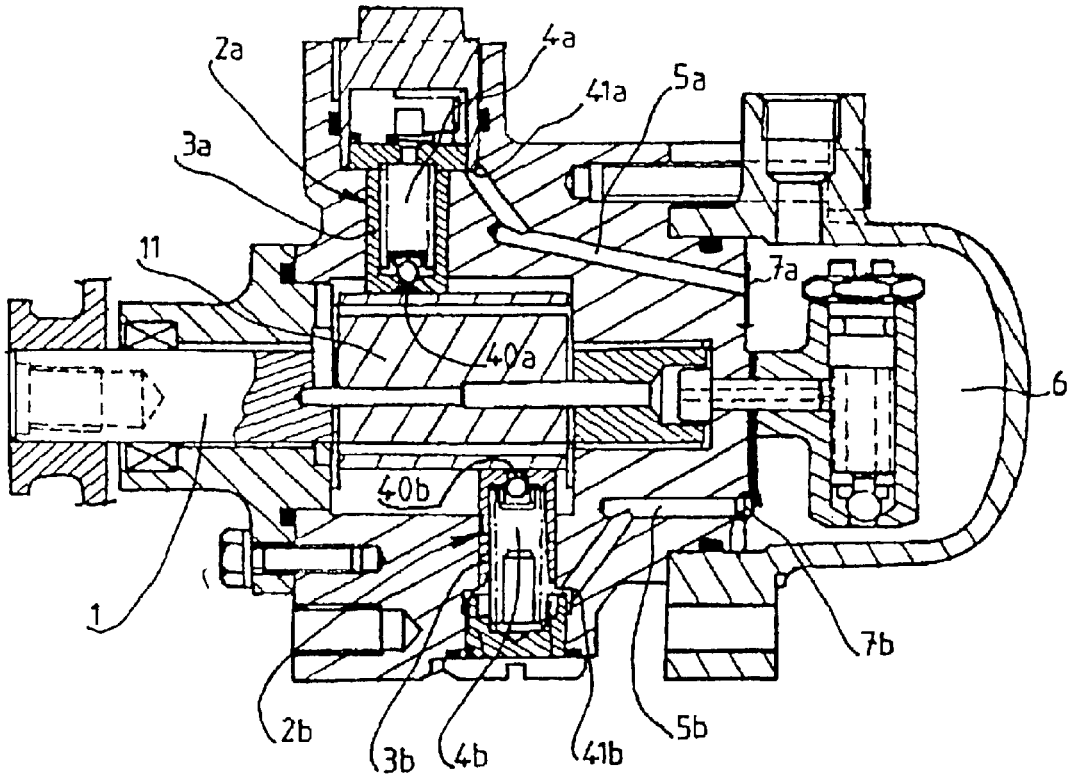

The present invention relates generally to multi-piston engines, such as for pumps or compressors, allowing one to put in motion or to pressurize a hydraulic, gaseous or even a polyphase fluid.

More precisely, the invention relates to a multi-piston engine comprising a drive shaft; a number of cylinders; a number of pistons selectively driven by the alternating motion of the drive shaft and respectively housed in the cylinders in order to delimit, for a fluid put in motion by the engine, a corresponding number of chambers with variable volume, each of which presents a determined maximum volume to the fluid and has a low pressure intake and a high pressure outlet; and a number of delivery channels connecting the high pressure outlets of the respective chambers to the delivery outlet of the engine, each delivery channel having a determined cross section and a determined length, the movement of each piston bringing about a vibrational excitation of the engine, at a determined fundamental frequency, and each chamber, in association with the piston which delimits it and with the delivery channel which connects it to the delivery outlet, forming a corresponding module of the engine.

Piston engines of this type are well known, particularly through French Patent No. 2 655 690, and are very widely used, particularly on motor vehicles for powering assisted hydraulic circuits such as ABS braking systems, automatic transmissions, power steering or suspensions, particularly hydropneumatic suspensions.

Although there are a number of sub-categories of piston engines of this type, which are represented in particular by the radial piston engines and the engines with axial pistons and tilting plates, the design of these piston engines always runs into the problem of reducing the noise and more generally the vibrations produced during operation.

French Patent No. 2 551 505 describes, for example, a pumping system for liquid phase chromatography which aims to reduce the instantaneous flow rate variations and which can possibly obtain a certain reduction in operating noise, at least as an incidental result.

Such a system nevertheless requires both the use of cams with a profile in the form of an arithmetic spiral and of cylinders with great dimensional differences between one another, where such structural constraints are very difficult to accept for engines for industrial use that are mass-produced.

FR 1 546 997 and DE 196 41 779 describe piston engines for industrial use which are primarily designed to operate with a reduced noise level.

The basic principle used in these known engines consists of arranging the cylinders in an irregular manner, so as to introduce an angular offset between the individual points of their respective operating cycles and to attenuate the resulting noise by shifting the phase between the different elementary noises which are emitted.

Nevertheless, this irregular arrangement of the cylinders makes machining of such engines relatively delicate and expensive.

BRIEF SUMMARY OF THE INVENTION

In this context, the invention aims to propose a piston engine which has clearly improved vibrational behavior, without requiring extensive structural modifications of structure with respect to standard piston engines.

To this end, the piston engine of the invention, which otherwise conforms to the generic description stated above, comprises at least a first spectral spreading means associated with a first pair of modules including a first pair of pistons, where this first spectral spreading means is suitable for introducing, between the fundamental frequencies of the vibrational excitations resulting from the respective movements of the pistons of this first pair, a frequency shift equal to no more than 10% of the fundamental frequency of the vibrational excitation resulting from the movement of either piston of this first pair.

Thus, instead of seeking to phase-shift the noise emitted by the ditterent modules, the invention solves the problem of noise reduction due to a relatively modest modification of the frequencies emitted by the different modules.

Preferably, the first spectral spreading means entails a difference between magnitudes respectively associated with the modules of the first pair of modules, each of these magnitudes being represented, for the associated module, by the ratio of the cross section of the delivery channel to the product of the maximum volume of the chamber and the length of the delivery channel.

In order to attain satisfactory effectiveness, the frequency shift introduced between the fundamental frequencies of the vibrational excitations resulting from the respective movements of the pistons of the first pair is equal to at least 1% of the fundamental frequency of the vibrational excitation resulting from the movement of either of said pistons.

Excellent results can be obtained by introducing, between the fundamental frequencies of the vibrational excitations resulting from the respective movements of the pistons of the first pair, a frequency shift of about 2% of the fundamental frequency of the vibrational excitation resulting from the movement of either of said pistons.

The invention thus allows the pistons which respectively delimit the chambers of the modules of the first pair of modules to be identical.

The first spectral spreading means can, for example, entail at least one difference between the maximum volumes of the respective chambers of the modules of the first pair of modules.

For this purpose, it is possible to provide different cylinders of the modules of the first pair of modules, for example, and which are machined in such a way as to have different lengths or diameters, where these differences, however, are then preferably provided outside of the regions in which the pistons move so that the pistons can remain unchanged and identical.

However, the cylinders of the modules of the first pair of modules can also be identical; at least one of these cylinders can then contain a solid filler block which modifies the maximum volume of the chamber defined by this cylinder.

Such a filler block is, for example, formed by a stack of several block elements all having the same volume and produced out of a flexible material such as polyurethane or a compressible elastomer.

The engine of the invention can have as many spectral spreading means as the number of pairs of modules containing neighboring pistons, and even possibly as many spectral spreading means as the number of modules.

In the engine of the invention, the cylinders can thus be arranged in a regular manner with respect to the drive shaft.

The advantages provided by the invention are particularly significant when each delivery channel is separated from the delivery outlet of the piston engine by a non-return valve.

Other characteristics and advantages of the invention will emerge clearly from the description given below, on an indicative and in no way limiting basis, in reference to the appended drawings in which:

BRIEF DESCRIPTION OF SEVERAL VIEWS OF THE DRAWING(s)

Figure 2:
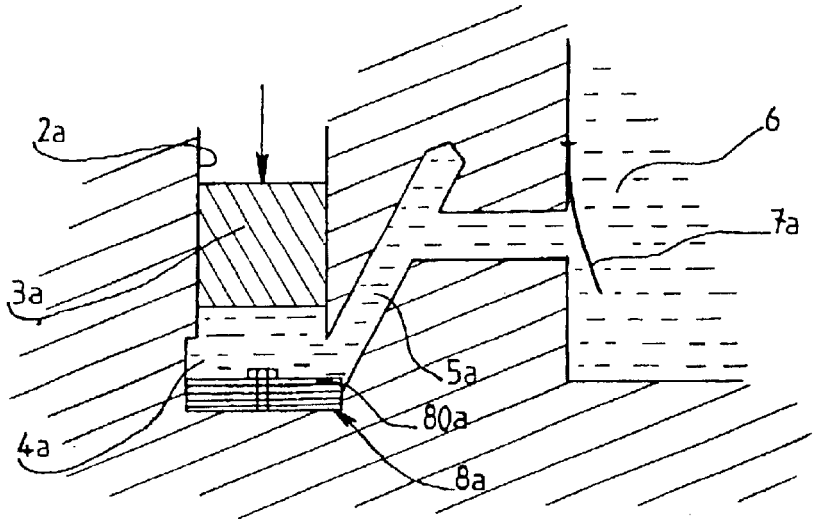

FIG. 1 is a cross section of a piston engine of the type to which the invention is applicable; and FIG. 2 is an enlarged schematic view of an engine module according to the invention.

BRIEF DESCRIPTION OF THE INVENTION

As shown in FIG. 1, the invention relates to a piston engine, which in this case constitutes a hydraulic pump, and which essentially has drive shaft 1, cylinders, such as 2*a*, 2*b*, pistons, such as 3*a*, 3*b*, which, in the cylinders, define chambers, such as 4*a*, 4*b*, delivery outlet 6 of the engine, and delivery channels, such as 5*a*, 5*b* connecting the chambers to delivery outlet 6.

Inasmuch as, for comprehension of the invention, the number of cylinders and pistons can be assumed to be any number, and particularly an even or odd number, provided that it is at least equal to two, the assumption will be made that the piston engine can contain at least one cylinder 2*c*, one piston 3*c*, one chamber 4*c*, and one delivery channel 5*c* in addition to those illustrated by FIG. 1.

Pistons 3*a*, 3*b*, 3*c* are given an alternating movement at will by drive shaft 1, inside of cylinders 2*a*, 2*b*, 2*c*, for example, by means of cam 11, so that chambers 4*a*, 4*b*, 4*c* have a variable volume, between a minimum volume that is as small as possible and a maximum volume, noted Va, Vb, Vc respectively, for chambers 4*a*, 4*b*, 4*c*.

Each chamber such as 4*a*, 4*b*, 4*c* has a low pressure intake such as 40*a*, 40*b*, 40*c* and a high pressure outlet such as 41*a*, 4*b*, 41*c* connected to the delivery outlet 6 of the piston engine through a corresponding delivery channel 5*a*, 5*b*, 5*c*, at the end of which an associated non-return valve 7*a*, 7*b*, 7*c* is installed, which prohibits circulation of fluid from the outlet 6 of the piston engine towards the corresponding chamber.

Each delivery channel such as 5*a*, 5*b*, 5*c* has a determined cross section Sa, Sb, Sc and a determined length La, Lb, Lc.

Each chamber, such as 4*a*, 4*b* or 4*c*, in association with a piston 3*a*, 3*b*, or 3*c* which delimits it in a cylinder such as 2*a*, 2*b*, or 2*c*, and in association with a delivery channel 5*a*, 5*b*, or 5*c* which connects this chamber to a delivery outlet 6, forms a corresponding module of the engine such as a module 3*a*, 4*a*, 5*a* illustrated in FIG. 2.

In practice, in the prior art, the chambers all have the same maximum volume V, and the delivery channels all have the same cross section S and the same length L.

Under these conditions, the movement of each piston 3*a*, 3*b*, 3*c* brings about a vibrational excitation of the piston engine, whose fundamental frequency F is given by the equation:

$$F=(\lambda\cdot S/4\pi^2\cdot\rho\cdot V\cdot L)^{1/2}$$

where λ is the coefficient of compressibility of the pumped fluid, and ρ is the specific gravity of this fluid.

The total excitation exerted on the piston engine during one revolution of drive shaft 1, and which is represented by the result of the excitations exerted by the movement of the different pistons, can thus, in the prior art, reach a considerable amplitude at the common excitation frequency F of the different modules of the piston engine.

In order to solve this problem, the invention provides a certain spectral spreading of the excitation frequencies of the different unit modules of the piston engine, which is obtained by introducing, for at least two different modules, for example, 3*a*, 4*a*, 5*a*, on the one hand, and 3*b*, 4*b*, 5*b*, on the other, a frequency shift ΔFab between the fundamental frequencies Fa, Fb of the vibrational excitations brought about by the pistons 3*a* and 3*b* of these two modules, that is, by making these frequencies Fa and Fb different.

More precisely, the frequency shift ΔFab thus introduced is, according to the invention, chosen to be equal to up to 10% of the fundamental frequency Fa of the vibrational excitation resulting from the movement of either of the pistons of these two modules, for example, of piston 3*a*.

In order to give the invention its greatest effectiveness, the frequency shift ΔFab introduced between the fundamental frequencies Fa, Fb of the vibrational excitations brought about by the given pistons of two modules, such as 3*a*, 4*a*, 5*a* and 3*b*, 4*b*, 5*b*, is chosen to be at least equal to 1% of the fundamental frequency Fa of the vibrational excitation brought about by piston 3*a* of any one of these modules, and is optimally chosen to be about 2% of this fundamental frequency Fa.

In order to better understand the possibilities offered by the invention, it is convenient for each module, such as 3*a*, 4*a*, 5*a* or 3*b*, 4*b*, 5*b*, to define a corresponding magnitude, such as Ga or Gb, given by:

$$Ga=Sa/(Va\cdot La) \text{ and } Gb=Sb/(Vb\cdot Lb).$$

In other words, for each module, this magnitude, such as Ga or Gb, is represented by the ratio of the cross section, Sa or Sb, of the delivery channel, 5*a* or 5*b*, to the product of the maximum volume, Va or Yb, of the chamber 4*a* or 4*b*, and the length, La or Lb, of the delivery channel 5*a* or 5*b*.

Under these conditions, the desired spectral spreading between the fundamental frequencies Fa, Fb of the vibrational excitations respectively attributable to two modules such as 3*a*, 4*a*, 5*a* and 3*b*, 4*b*, 5*b*, is obtained by making the magnitudes Ga and Gb respectively associated with these modules different, which can be obtained by introducing a difference in the respective maximum volumes Va and Vb of the chambers of these modules, or in the respective cross sections Sa, Sb of the delivery channels 5*a*, 5*b* of these modules, or in the respective lengths La, Lb of these delivery channels 5*a*, 5*b*, or else in several of these parameters at the same time, insofar as the effects of such modifications relating to several magnitudes at the same time do not compensate for one another, and that the magnitudes Ga and Gb are therefore indeed different from one another.

Preferably, the frequency shift intended for ensuring the desired spectral spreading is introduced between the fundamental frequencies of the vibrational excitations is brought about by each pair of modules which contain neighboring pistons.

Thus, if the piston engine contains an even number of modules arranged in a circle, it is preferable to make the excitation frequencies resulting from the functioning of two neighboring modules different, which can be brought about with a minimum of two different excitation frequencies.

If, for example, the piston engine contains four modules, the first of which is designated 3*a*, 4*a*, 5*a*, the second 3*b*, 4*b*, 5*b*, the third 3*c*, 4*c*, 5*c*, and the fourth 3*d*, 4*d*, 5*d*, and if these modules are arranged in a circle successively in this order, the invention can be implemented by making Fb≠Fa and Fd≠Fc, even if Fc=Fa and Fd=Fb.

Nevertheless, it can prove to be advisable to control each excitation frequency to make ensure that the excitation frequencies are all different from one another.

For a frequency Fa between 800 and 1000 Hz, the frequency shift ΔFab can be chosen so as typically to be on the order of 20 Hz.

Since the parameters Sa, Va and La which define each magnitude such as Ga=Sa/(Va·La) do not include the diameter of the cylinders such as 2*a*, it is possible to implement the invention while using pistons, such as 3*a*, which are identical for all the modules.

Likewise, the cylinders such as 2*a*, 2*b*, 2*c* can be arranged in a regular manner with respect to drive shaft 1, and for example, around this drive shaft, instead of having to be distributed in an irregular manner, as is the case in FR 1 546 997 and DE 196 41 779 mentioned above.

A simple means of implementing the invention can consist of introducing a difference, such as ΔVab, between the maximum volumes, such as Va and Vb, of the chambers, such as 4*a* and 4*b*, of the different modules such as 3*a*, 4*a*, 5*a* and 3*b*, 4*b*, 5*b*.

For this purpose, two methods can be considered in particular, the first consisting of machining the cylinders, in which the chambers are defined, in such a way that they are different from one another.

In order to be able to use identical pistons that work over identical stroke lengths, it is then preferable to modify the cylinders only in the dead volumes, that is, in the parts of the cylinders which are not reached by the pistons and which define the minimum volumes of the chambers.

The second way, which is even more advantageous, consists of using identical cylinders, and of placing, in each of the cylinders of the modules whose fundamental frequency must be modified, a solid filler block, such as 8*a* (FIG. 2), which has the effect of modifying the maximum volume Va of chamber 4*a* defined in this cylinder 2*a*.

Preferably, filler block 8*a* is formed by a stack of several block elements of the same volume, such as 80*a*.

Finally, this filler block 8*a* is advantageously produced from a flexible material, such as polyurethane or a compressible elastomer.

What is claimed is:

1. A multi-piston engine, comprising a drive shaft; at least two cylinders and pistons, the pistons being selectively driven by the alternating motion of the drive shaft and being respectively housed in the cylinders in order to delimit, for a fluid put in motion by the engine, a corresponding number of chambers with variable volume, each of which presents a predetermined maximum volume to the fluid and has a low pressure intake and a high-pressure outlet; and a corresponding number of delivery channels connecting the high pressure outlets of the respective chambers to the delivery outlet of the engine, each delivery channel having a predetermined cross section and a predetermined length, the movement of each piston bringing about a vibrational excitation of the engine, of determined fundamental frequency, and each chamber, in association with the piston which delimits the chamber and with the delivery channel which connects the chamber to the delivery outlet, forming a corresponding module of the engine, the engine further comprising at least a first spectral spreading means associated with a first pair of modules including a first pair of pistons, the first spectral spreading means being suitable for introducing, between the fundamental frequencies of the vibrational excitations resulting from the respective movements of the pistons of the first pair, a frequency shift (ΔFab) equal to at most 10% of the fundamental frequency of the vibrational excitation resulting from the movement of either of the pistons of the first pair.

2. The multi-piston engine according to claim 1, wherein the first spectral spreading means entails a difference between the magnitudes respectively associated with the modules of the first pair of modules, each of the magnitudes being represented, for the associated module, by the ratio (Sa/(Va·La), Sb/(Vb·Lb)) of the cross section of the delivery channels of the module to the product of the maximum volume of the chambers of the module and the length of the delivery channels of the module.

3. The multi-piston engine of claim 2, wherein the first spectral spreading means entails at least a difference (ΔVab) between the maximum volumes of the respective chambers of the modules of the first pair of modules.

4. The multi-piston engine according to claim 3, wherein the cylinders of the modules of the first pair of modules are different from each other in length or diameter.

5. The multi-piston engine of claim 2, wherein the frequency shift (ΔFab) introduced between the fundamental frequencies of the vibrational excitations resulting from the respective movements of the pistons of the first pair is at least equal to 1% of the fundamental frequency of the vibrational excitation resulting from the movement of either of the pistons.

6. The multi-piston of claim 2, wherein the pistons respectively delimiting the chambers of the modules of the first pair of modules are identical to each other in length or diameter.

7. The multi-piston engine of claim 6, wherein the frequency shift (ΔFab) introduced between the fundamental frequencies of the vibrational excitations resulting from the respective movements of the pistons of the first pair is 2% of the fundamental frequency of the vibrational excitation resulting from the movement of either of the pistons.

8. The multi-piston engine of claim 2, wherein the cylinders of the modules of the first pair of modules are identical to each other in length or diameter, and at least one of the cylinders contains a solid filler block which modifies the maximum volume of the chamber defined in the cylinder.

9. The multi-piston engine according to claim 1, wherein the frequency shift (ΔFab) introduced between the fundamental frequencies of the vibrational excitations resulting from the respective movements of the pistons of the first pair is at least equal to 1% of the fundamental frequency of the vibrational excitation resulting from the movement of either of the pistons.

10. The multi-piston engine according to claim 9, wherein the frequency shift (ΔFab) introduced between the fundamental frequencies of the vibrational excitations resulting from the respective movements of the pistons of the first pair is 2% of the fundamental frequency of the vibrational excitation resulting from the movement of either of the pistons.

11. The multi-piston engine of claim 9, wherein the cylinders of the modules of the first pair of modules are identical to each other in length or diameter, and at least one of the cylinders contains a solid filler block which modifies the maximum volume of the chamber defined in the cylinder.

12. The multi-piston of claim 1, wherein the pistons respectively delimiting the chambers of the modules of the first pair of modules are identical to each other in length or diameter.

13. The multi-piston engine of claim 1, wherein the cylinders of the modules of the first pair of modules are identical to each other in length or diameter, and at least one of the cylinders contains a solid filler block which modifies the maximum volume of the chamber defined in the cylinder.

14. The multi-piston engine according to claim 13, wherein the filler block comprises a stack of at least 2 block elements each having the same volume.

15. The multi-piston engine of claim 14, wherein the filler block is produced from a flexible material or a compressible elastomer.

16. The multi-piston engine according to claim 13, wherein the filler block is produced from a flexible material or a compressible elastomer.

17. The multi-piston engine of claim 1, comprising as many spectral spreading means as the number of pairs of modules containing neighboring pistons.

18. The multi-piston engine of claim 1, comprising as many spectral spreading means as the number of modules.

19. The multi-piston engine of claim 1, wherein the cylinders are angularly equidistant from each other around the drive shaft.

20. The multi-piston engine of claim 1, wherein each delivery channel is separated from the delivery outlet by a non-return valve.

* * * * *